US011041265B2

(12) United States Patent
Mathews

(10) Patent No.: US 11,041,265 B2
(45) **Date of Patent: *Jun. 22, 2021**

(54) LEVEL CUT LOOP LOOPER AND CLIP ASSEMBLY

(71) Applicant: Card-Monroe Corp., Chattanooga, TN (US)

(72) Inventor: Ricky E. Mathews, Sale Creek, TN (US)

(73) Assignee: Card-Monroe Corp., Chattanooga, TN (US)

( * ) Notice: Subject to any disclaimer, the term of this patent is extended or adjusted under 35 U.S.C. 154(b) by 108 days.

This patent is subject to a terminal disclaimer.

(21) Appl. No.: 16/403,659

(22) Filed: May 6, 2019

(65) Prior Publication Data

US 2019/0264359 A1 Aug. 29, 2019

Related U.S. Application Data

(63) Continuation of application No. 15/456,948, filed on Mar. 13, 2017, now Pat. No. 10,280,541, and a continuation of application No. 14/751,904, filed on Jun. 26, 2015, now Pat. No. 9,593,437.

(60) Provisional application No. 62/017,874, filed on Jun. 27, 2014.

(51) Int. Cl.

| | |
|---|---|
| ***D05C 15/22*** | (2006.01) |
| ***D05C 15/24*** | (2006.01) |
| ***D05C 15/36*** | (2006.01) |

(52) U.S. Cl.

CPC ..... *D05C 15/22* (2013.01); *D05C 15/24* (2013.01); *D05C 15/36* (2013.01)

(58) Field of Classification Search

CPC ..... D05C 15/22; D05C 15/10; D05C 15/04; D05C 15/08; D05C 15/24; D05C 15/36; D05C 17/02; D05C 17/026

See application file for complete search history.

(56) References Cited

U.S. PATENT DOCUMENTS

| | | | | |
|---|---|---|---|---|
| 2,990,792 A | | 7/1961 | Nowicki et al. | |
| 3,203,379 A | * | 8/1965 | Dedmon ..... | D05C 15/22 112/80.52 |
| 3,812,799 A | | 5/1974 | Spanel et al. | |
| 3,919,953 A | | 11/1975 | Card et al. | |

(Continued)

OTHER PUBLICATIONS

International Search Report and Written Opinion for related application, PCT/US2015/038030, dated Sep. 15, 2015.

(Continued)

*Primary Examiner* — Ismael Izaguirre

(74) *Attorney, Agent, or Firm* — Womble Bond Dickinson (US) LLP

(57) ABSTRACT

A level cut loop looper or hook and clip assembly for a tufting machine includes at least one module carrying a series of level cut loop loopers or hooks. Each level cut loop looper or hook generally can include a looper body along which a clip is slidably moved. Each clip will be moved between retracted and extended positions as the level cut loop loopers or hooks are reciprocated toward and away from engagement with their associated needles of the tufting machine. Actuators can be engaged to secure the clips in their extended positions as needed to selectively form cut and loop pile tufts in a backing material.

14 Claims, 4 Drawing Sheets

(56) References Cited

U.S. PATENT DOCUMENTS

| | | | |
|---|---|---|---|
| 3,976,298 | A | 8/1976 | Hinchman |
| 4,111,407 | A | 9/1978 | Stager |
| 4,134,347 | A | 1/1979 | Jolley |
| 4,155,319 | A | 5/1979 | Short |
| 4,185,569 | A | 1/1980 | Inman |
| 4,194,403 | A | 3/1980 | Santoro |
| 4,195,580 | A | 4/1980 | Hurst |
| 4,235,175 | A | 11/1980 | Cobble |
| 4,241,675 | A | 12/1980 | Bardsley |
| 4,285,286 | A | 8/1981 | Hash |
| 4,303,024 | A | 12/1981 | Bardsley |
| 4,313,388 | A | 2/1982 | Biggs et al. |
| 4,314,347 | A | 2/1982 | Stokely |
| 4,353,317 | A | 10/1982 | Crumbliss |
| 4,466,366 | A | 8/1984 | Hirotsu |
| 4,522,132 | A | 6/1985 | Slattery |
| 4,608,935 | A | 9/1986 | Bardsley |
| 4,660,460 | A | 4/1987 | Fulmer |
| 4,860,674 | A | 8/1989 | Slattery |
| 5,042,405 | A | 8/1991 | Bradley et al. |
| 5,182,997 | A | 2/1993 | Bardsley |
| 5,224,434 | A | 7/1993 | Card et al. |
| 5,295,450 | A | 3/1994 | Neely |
| 5,345,885 | A | 9/1994 | Yoshino |
| 5,400,727 | A | 3/1995 | Neely |
| 5,509,364 | A | 4/1996 | Bardsley |
| 5,513,586 | A | 5/1996 | Neely |
| 5,706,744 | A | 1/1998 | Card et al. |
| 5,896,821 | A | 4/1999 | Neely et al. |
| 6,155,187 | A | 12/2000 | Bennett et al. |
| 6,758,154 | B2 | 7/2004 | Johnston |
| 6,807,917 | B1 | 10/2004 | Christman et al. |
| 6,834,601 | B2 | 12/2004 | Christman et al. |
| 6,834,602 | B1 | 12/2004 | Hall |
| 6,895,877 | B1 | 5/2005 | Weiner |
| 7,007,617 | B2 | 3/2006 | Johnston |
| 7,096,806 | B2 | 8/2006 | Card et al. |
| 7,165,500 | B1 | 1/2007 | Yoshino |
| 7,222,576 | B2 | 5/2007 | Kilgore |
| 7,237,497 | B2 | 7/2007 | Johnston |
| 7,284,492 | B2 | 10/2007 | Johnston |
| 7,347,151 | B1 | 3/2008 | Johnston et al. |
| 7,398,739 | B2 | 7/2008 | Johnston et al. |
| 7,438,007 | B1 | 10/2008 | Hall |
| 7,490,566 | B2 | 2/2009 | Hall |
| 7,562,632 | B2 * | 7/2009 | Hillenbrand ..... D05C 15/22 112/80.55 |
| 7,597,057 | B2 | 10/2009 | Johnston et al. |
| 7,634,326 | B2 | 12/2009 | Christman, Jr. et al. |
| 7,739,970 | B2 | 6/2010 | Hall |
| 7,814,850 | B2 | 10/2010 | Bearden |
| 8,082,861 | B2 | 12/2011 | Lovelady et al. |
| 8,082,862 | B2 | 12/2011 | Hillenbrand et al. |
| 8,215,248 | B2 | 7/2012 | Kilgore |
| 8,646,396 | B2 | 2/2014 | Shanley |
| 9,593,437 | B2 | 3/2017 | Mathews |
| 10,280,541 | B2 | 5/2019 | Mathews |
| 2005/0109253 | A1 | 5/2005 | Johnston |
| 2006/0225630 | A1 | 10/2006 | Kilgore |
| 2007/0272137 | A1 | 11/2007 | Christman et al. |
| 2007/0272138 | A1 | 11/2007 | Johnston |
| 2008/0210146 | A1 | 9/2008 | Hall |
| 2009/0056606 | A1 | 3/2009 | Lovelady |
| 2009/0078180 | A1 | 3/2009 | Hall |
| 2009/0205547 | A1 | 8/2009 | Hall |
| 2012/0174846 | A1 | 7/2012 | Hall |
| 2014/0272260 | A1 | 9/2014 | Weiner et al. |

OTHER PUBLICATIONS

Extended European Search Report for related application, EP 15 810 900.9-1018 / 3161201 PCT/US2015038030, dated Feb. 9, 2018.

European Examination Report for related application, EP 15 810 900.9-1018, dated Dec. 7, 2018.

* cited by examiner

LEVEL CUT LOOP LOOPER AND CLIP ASSEMBLY

CROSS REFERENCE TO RELATED APPLICATIONS

The present patent application is a continuation of previously filed, co-pending U.S. patent application Ser. No. 15/456,948 filed Mar. 13, 2017 which is a continuation of previously filed U.S. patent application Ser. No. 14/751,904, filed Jun. 26, 2015, which is a formalization of U.S. Provisional Patent Application Ser. No. 62/017,874, filed Jun. 27, 2014 by the inventor named in the present application. This patent application claims the benefit of the filing date of the patent application cited above according to the statutes and rules governing continuing patent applications, particularly 35 U.S.C. §§ 120 and 121 and 37 C.F.R. § 1.78(d)(2) and (d)(3). The specifications and drawings of each of the United States Utility and Provisional patent applications referenced above are specifically incorporated herein by reference as if set forth in their entirety.

FIELD OF THE INVENTION

The present invention generally relates to systems for tufting articles such as carpets and in particular to a level cut loop looper and clip assembly for a tufting machine for selectively controlling the formation of loop pile and cut pile tufts of yarns in a backing material to form patterned tufted articles.

BACKGROUND OF THE INVENTION

In the field of tufting carpets, it has been known to tuft carpets having spaced rows of loop pile and cut pile tufts, including the formation of loop pile and cut pile tufts in the same longitudinal tuft rows of the carpet. For example, U.S. Pat. Nos. 5,224,434 and 5,706,744 disclose systems and methods for tufting loop pile tufts and cut pile tufts of yarns in the same longitudinal tuft rows formed in a backing material, using a multi-needle tufting machine having spaced rows of needles that cooperate with a series of loop pile loopers or cut pile hooks mounted along upstream and downstream sides, respectively, of the tufting machine.

Additionally, patents such as U.S. Pat. Nos. 7,347,151 and 7,438,007 disclose level cut loop hooks or loopers for tufting machines. Such level cut loop hooks or loopers typically include a hook body along which loops of yarns can be captured and thereafter cut by an associated reciprocating cutting blade forming cut pile tufts in the backing. The level cut loop hooks or loopers also generally include a slidable clip that can be moved into a position adjacent or in engagement with the front end of the hook body to block or otherwise prevent loops of yarns from being retained on the level cut loop hook or looper, for formation of loop pile tufts in the backing. Such clips typically have been engaged or driven by actuators such as hydraulic cylinders, with each clip being connected to an associated cylinder by connecting linkages and/or gates. As a result, however, the operation of such level cut loop hooks or loopers generally has been limited by the speed at which the cylinders can operate to extend and retract the clips. In addition, such conventional level cut loop hook or looper assemblies also generally require a compressor to provide air/fluid to the cylinders, substantially adding to the cost of operation of such assemblies, while the connecting linkages between the clips and their actuators can further add to the complexity of such level cut loop hook or looper assemblies and limit their operation.

Accordingly, it can be seen that a need exists for a level cut loop hook or looper and clip assembly that addresses the foregoing and other related and unrelated problems in the art.

SUMMARY OF THE INVENTION

Briefly described, the present invention generally relates to an improved level cut loop looper clip assembly for use in selectively forming cut and/or loop and/or pile tufts of yarns in a backing material passing through the tufting zone of a tufting machine to form various tufted patterned articles such as carpets. The level cut loop looper and clip assembly of the present invention generally can include one or more gauging modules or blocks each carrying a series of level cut loop loopers or hooks therein. Each of the level cut loop loopers or hooks generally will comprise a looper or hook having an elongated body including a shank or rear portion received within the module or block, and a forwardly extending throat portion that terminates in a front or forward end. The level cut loop looper and clip assembly also can be formed as a unit or modular structure configured to be mounted in series with additional units along a gauge or hook bar that is connected to a drive mechanism for driving the level cut loop looper and clip assemblies/units in a reciprocating motion toward and away from engagement with the needles of the tufting machine as the needles are reciprocated into and out of the backing material.

Each of the level cut loop loopers or hooks further generally includes a clip that is slidably received along the body of its level cut loop loopers or hook. Each of the clips can include an elongated body having a first, proximal or front end configured to substantially block or retard the retention of loops of yarns along the throat portion of its associated level cut loop looper or hook, and a second, distal or rear end that projects rearwardly from its level cut loop looper or hook. In one embodiment, pivot arms can connect the body of each clip to a spring or other biasing member and/or to a housing of one of the units or modules of the level cut loop looper and clip assembly. The springs can provide a biasing force to urge their clips to a retracted or non-engaging position for selectively forming cut pile tufts in the backing.

A stop member generally will be located in a position spaced rearwardly from the clips. As the level cut loop loopers or hooks are reciprocated rearwardly away from the needles, the rear ends of their clips can engage the stop member, causing the clips to be urged or moved along the bodies of their level cut loop loopers or hooks so that the front ends of the clips are extended into an engaging or blocking position adjacent the front ends or bills of their level cut loop loopers or hooks. Thereafter, as the level cut loop loopers or hooks are reciprocated forwardly, toward the needles, the springs coupled to the pivot arms of the clips can exert a biasing force that urges the clips rearwardly toward their retracted position with respect to the level cut loop loopers or hooks. As a result, the level cut loop loopers or hooks can pick-up and retain loops of yarns therealong, which yarns thereafter can be cut by a series of knives to form cut pile tufts of yarns in the backing.

The level cut loop looper and clip assembly further will include a series of actuators. In one embodiment, the actuators can comprise solenoids, such as direct acting solenoids, piezo-electric actuators, pneumatic or hydraulic cylinders, or other actuators. Each of the actuators generally will be mounted in a position above a corresponding or associated clip of one of the level cut loop loopers, and can include a detent or locking member selectively extendable into engagement with a slot or locking recess formed in the body or a clip associated therewith for selectively locking the clips in an extended position. As the level cut loop loopers are reciprocated rearwardly and their clips engage the stop member and are caused to slide along their level cut loop loopers, the actuators can be selectively activated so as to engage and thus substantially fix the clips of selected level cut loop loopers or hooks in their extended or blocking configuration. As a result, the selected level cut loop loopers or hooks can engage and pick up a loop of yarn from their corresponding or associated needles, which loops of yarns generally will not be retained along the level cut loop loopers or hooks, thus enabling the selective formation of loop pile tufts of yarns in the backing material.

In one embodiment, the level cut loop looper and clip assemblies further can include a housing or support structure, which can be molded, cast or machined, and in or along which one or more level cut loop looper or hooks, which can be cast or mounted in gauge modules, can be received. The housing also can include one or more passages through which the clips will move, and further can be configured with a series of stepped areas or offset portions to facilitate mounting of a series of level cut loop looper assembly units or modules in a substantially nested arrangement or series. The actuators also can be arranged in an offset or nested configuration to facilitate the compact mounting of the series or desired number of actuators along the housing. In addition, the pivot arms of the clips can be formed in varying lengths to enable the springs or other biasing members of the clips to be mounted or connected to the housing at varying or staggered elevations, and/or different size springs can be used, in order to help provide a substantially compact assembly or unit.

Various objects, features and advantages of the present invention will become apparent to those skilled in the art upon a review of the following detailed description, when taken in conjunction with the accompanying drawings.

Figure 1:
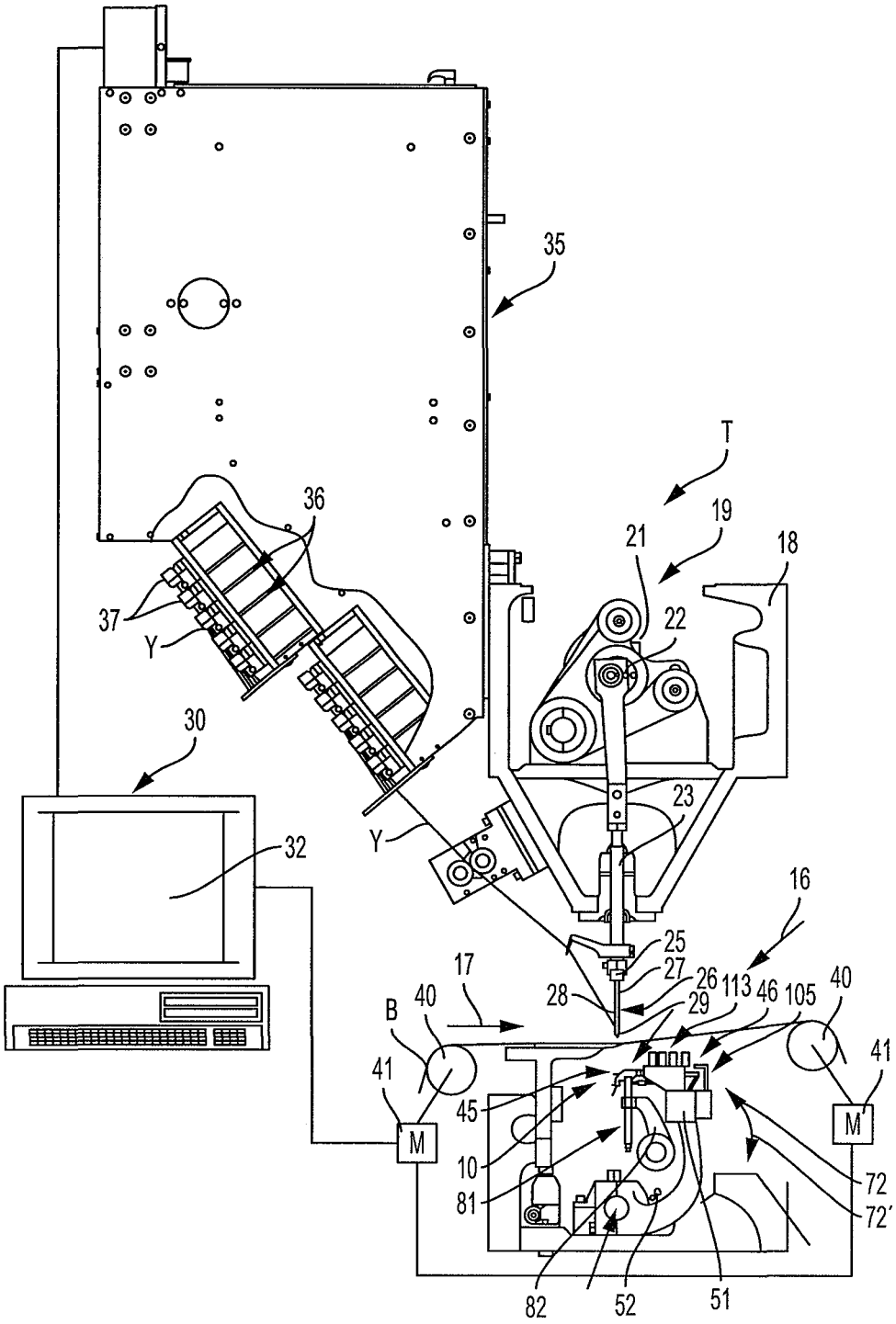
FIG. 1 is a side elevational view of one example embodiment of a tufting machine including a level cut loop looper and clip assembly according to the principles of the present invention.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments and/or features of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION OF THE INVENTION

Referring now in greater detail to the drawings in which like numerals indicate like parts throughout the several views, the present invention generally relates to a level cut loop looper and clip assembly 10 (FIGS. 1-5) for use in a tufting machine T (FIG. 1) for forming tufted carpets or other similar tufted articles having loop pile and cut pile tufts 12 and 13 (FIG. 3A) formed in a backing material B, including being formed in the same longitudinal tuft rows, as the backing material is fed through a tufting zone 16 of the tufting machine T in the direction of arrow 17. As indicated in FIG. 1, the tufting machine T generally will include a supporting framework or frame 18, with a main drive 19, including one or more motors 21, driving a main drive shaft 22, which in turn reciprocates a series of push rods 23 so as to drive one or more needle bars 25 along a reciprocating movement or stroke so as to move the needles 26 mounted therealong between a raised, non-engaging position wherein the needles are out of the backing material or fabric B as shown in FIG. 1, and a lowered, engaging position as shown in FIG. 3A, in which the needles penetrate the backing material B to a depth sufficient to be engaged, and loops L of yarns Y picked therefrom by the level cut loop loopers or hooks 45 of the level cut looper and clip assembly 10.

In one embodiment, the tufting machine can include a single needle bar 25 with a series of needles 26 arranged in spaced series in a substantially-in-line alignment along the length of the needle bar. Alternatively, the tufting machine T can include a staggered needle bar having multiple rows of spaced needles, with the rows of needles being spaced apart in the direction of movement of the backing B, as indicated by arrow 17, by a desired stagger or longitudinal spacing. In addition, while only a single needle has been shown along a single needle bar, it will be understood that a series of needles transversely spaced at a prescribed gauge or spacing along one or more needle bars, can be used, with the number of needles used generally based upon a prescribed gauge and/or size of the tufting machine. For example, a pair of needle bars can be used with each carrying one or more rows of needles that are separated or offset by desired stagger. The needle bar(s) also can include a shiftable needle bar that can be shifted transversely across the tufting zone 16 by a shift mechanism such as a cam, servomotor, or other shift mechanism, such as a Smart Step™ shifter mechanism produced by Card-Monroe Corp.

Figure 3A:
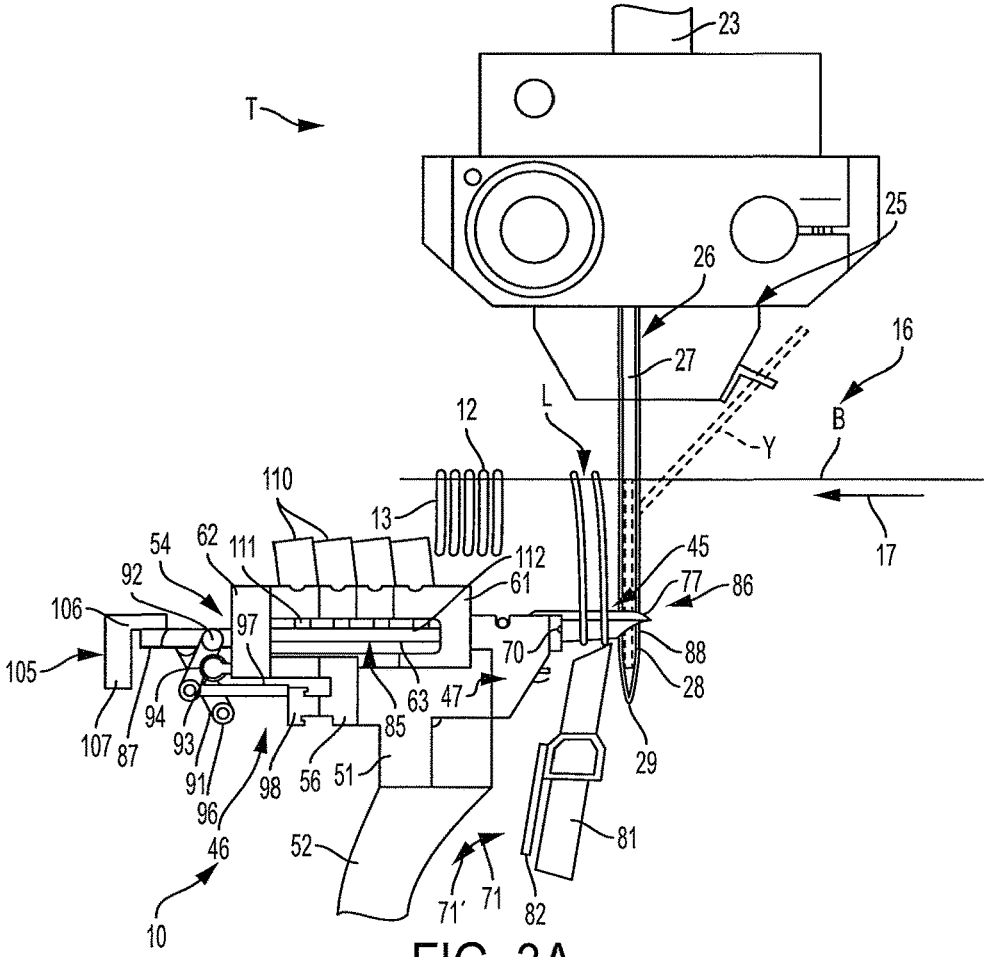
FIGS. 3A and 3B are side elevational views of the level cut loop looper and clip assembly of FIG. 2.

As indicated in FIGS. 1 and 3A, the needles 26 carry a series of yarns as the needles are reciprocated vertically into and out of the backing material B so as to form the loop and cut pile tufts 12 and 13, respectively, in the backing material. Each of the needles 26 generally can include a channel 27 that extends at least partially along the length of each needle and terminates at a take-off or pickup area 28 adjacent the lower end or point 29 of each needle. The pickup or take-off area 28 of each of the needles defines an area or point at which the level cut loop looper or hooks 45 of the level cut loop looper and clip assemblies 10 engage the needles and pick the loops L of yarn Y therefrom, as illustrated in FIG. 3A.

The tufting machine further can include a control system 30 (FIG. 1), such as a "Command Performance™" tufting machine computer control system as manufactured by Card-Monroe Corp., having a computer controller or processor that can be programmed with pattern information or instructions and/or other information for controlling the tufting operations of the tufting machine. The control system can communicate with and can be programmed to control various operative features, elements and functions of the tufting machine, including monitoring and controlling the motor(s) 21 driving the main drive shaft 22 of the tufting machine, controlling feeding of the yarns to the needles, movement or feeding of the backing B, as well as the control of a needle bar shift mechanism as needed to form a desired tufted pattern. In one embodiment, as understood by those skilled in the art, an encoder, resolver, or other similar monitoring device also can be mounted on the main drive shaft for detecting and providing feedback information regarding the position of the main drive shaft during its operation, while in other embodiments, the motor(s) can provide such position feedback information. Additionally, the control system 30 can include a user interface 32, such as a touch screen, keyboard and mouse, tablet or other, similar input device to enable operator input in programming the control system. The control system further can be connected to a separate pattern design center or system server for receiving pattern instructions, or can include pattern design functionality or capability to enable the creation and programming of patterns directly therein.

As further indicated in FIG. 1, a plurality of yarns Y will be fed to each of the needles 26 by one or more yarn feed mechanisms 35. The yarn feed mechanism(s) 35 can include one or more standard or conventional yarn feed mechanisms mounted along the upstream and/or downstream sides of the tufting machine. In one embodiment, the yarn feed mechanism 35 can include a series of yarn feed devices 36 that receive a plurality of yarns Y from a yarn supply, such as a creel, beam or other yarn supply mechanism, and drive a series of yarn feed rolls 37 to feed the yarns Y to the needles 26 as needed to form various tufted pattern effects. The one or more yarn feed mechanism(s) can include various yarn feed pattern attachments or devices, such as scroll, roll, single end, and/or double end yarn feed attachments or devices, for example an Infinity™ Infinity IIE™ or Yarntronics' pattern attachment or yarn feed system as manufactured Card-Monroe Corp., for controlling the feeding of yarns to selected groups or selected ones of the needles, including varying the yarn feed in accordance with pattern instructions as needed to form a desired pattern of tufts of yarns in the backing material. Also, while a single yarn feed mechanism is shown on one side of the tufting machine, it will be understood that additional yarn feed mechanisms can be mounted on one or both sides of the tufting machine.

As additionally shown in FIG. 1, the backing material B is generally fed through the tufting zone 16 by backing feed rolls 40 operated under control of drive motors 41. The drive motors typically can be linked to the tufting machine control system 30 for driving or feeding the backing B through the tufting zone 16 at a desired stitch rate. As the backing is fed through the tufting zone the needles are reciprocated through the backing material, where they are engaged by the level cut loop loopers or hooks 45 of the level cut loop looper and clip assembly 10 for selectively forming cut and loop pile tufts 12/13 in the backing B as indicated in FIG. 3A.

Figure 2:
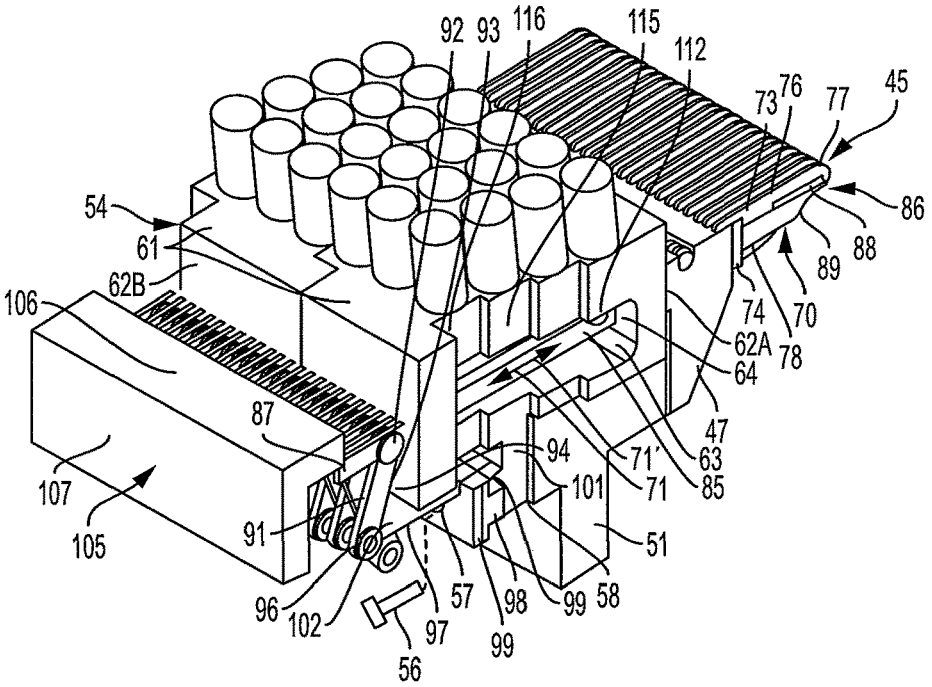
FIG. 2 is a perspective illustration of one embodiment of a level cut loop looper and clip assembly according to the principles of the present invention.
Figure 3B:
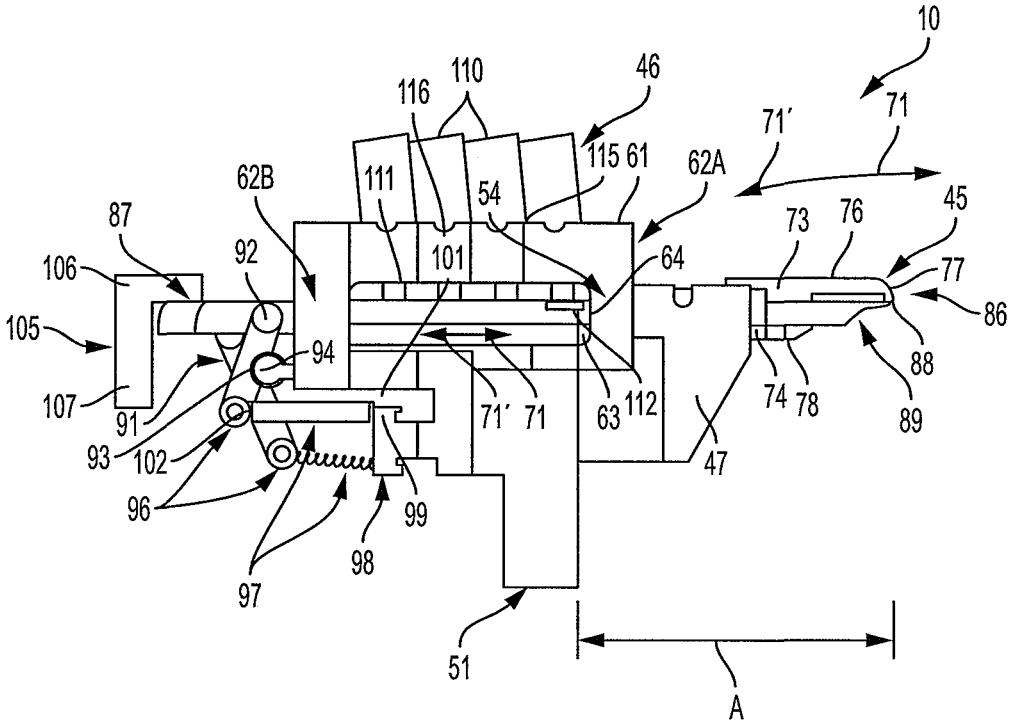
Figure 4:
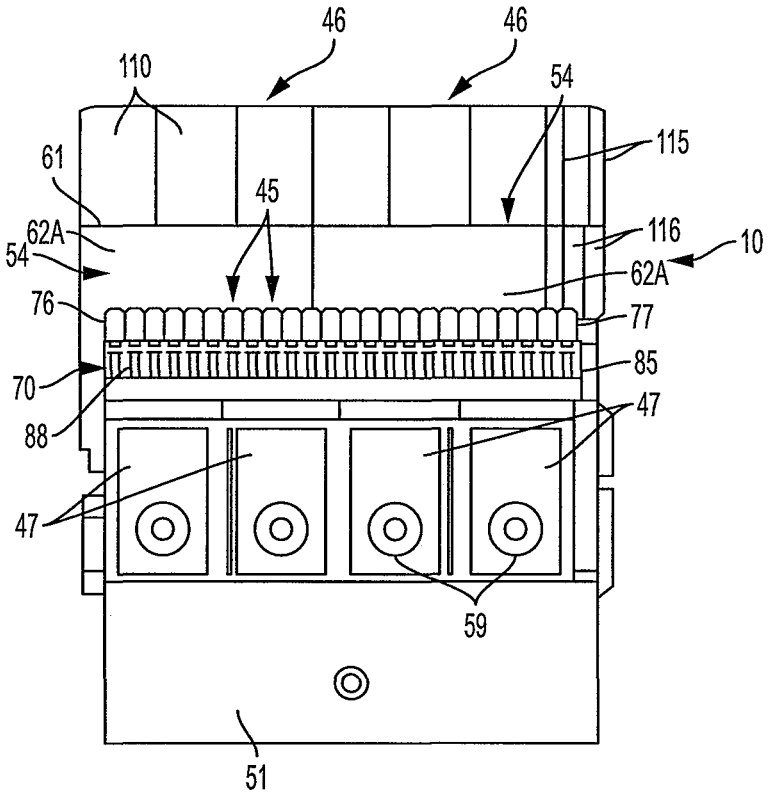
FIG. 4 is an end view of the level cut loop looper and clip assembly of FIGS. 2-3B.
Figure 5:
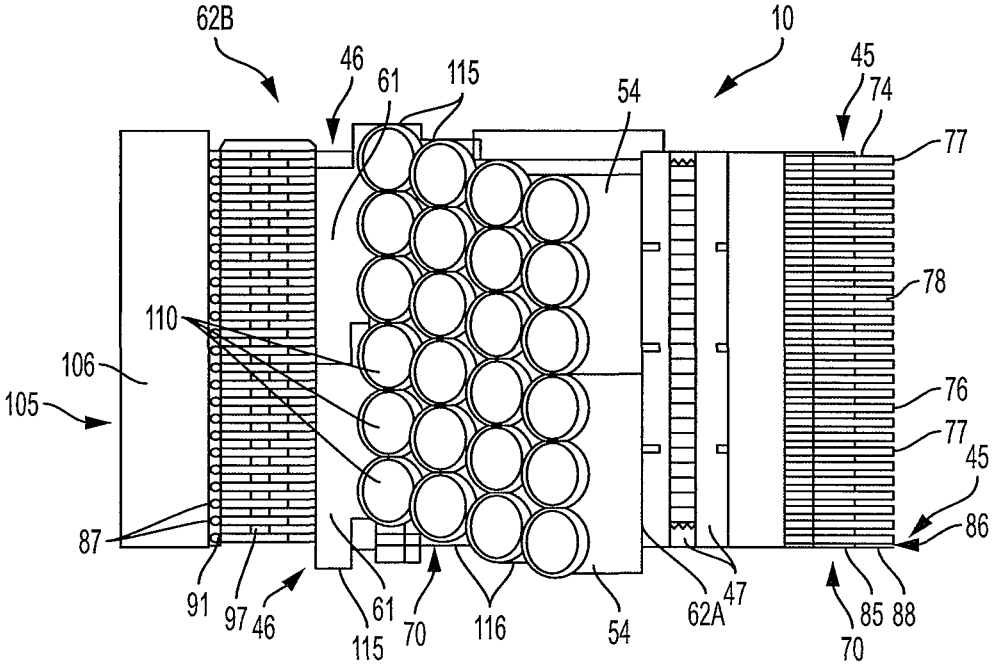
FIG. 5 is a plan view of the level cut loop looper and clip assembly of FIGS. 2-4.

As further illustrated in FIGS. 2-5, the level cut loop looper and clip assembly 10 generally can include one or more modules or units 46, each of which will have a series of level cut loop loopers or hooks 45 mounted in spaced series therealong. In one embodiment, the level cut loop loopers or hooks can be received and/or mounted in one or more gauging modules or blocks 47, which can be mounted in spaced series along each unit or module 46. For example, as indicated in FIGS. 2, 4 and 5, each unit of the level cut loop looper and clip assembly can have one or two gauge modules, mounted thereto, although other arrangements, including greater numbers of gauge modules and/or different configuration modules, also can be provided. The gauge modules 47 can generally comprise conventional level cut loop looper or hook modules, each including a module body 49 in which the level cut loop loopers or hooks can be cast, fitted, and/or otherwise mounted or secured. The gauge modules further can be located and secured along a gauge bar or support 51, which further can act as a base or support for the level cut loop looper and clip assembly 10, and which generally is configured to mount to a rocker arm 52 or similar looper drive mechanism as illustrated in FIGS. 1 and 3A, and as will be understood by those skilled in the art.

As further illustrated in FIG. 2, the units 46 of the level cut loop looper and clip assembly 10 each further can include a housing or unit body 54 that can be formed as a substantially unitary or one-piece structure such as by being molded, cast or machined. The housing of each level cut loop looper assembly unit further generally can be mounted to the gauge bar 51 by a series of fasteners. For example, in one embodiment, the housings 54 can be secured to the gauge bar by fasteners 56 inserted through openings 57 formed in a rearward-facing base or lower section 58 thereof and into the rear surface of the gauge bar 51, as indicated in FIG. 2. In addition, the gauge modules 47 carrying the level cut loop loopers or hooks 45 can be secured to the housing of each level cut loop looper and clip assembly unit and/or to the gauge bar 52 via fasteners 59 (FIG. 4) inserted through a front surface of each of the gauge modules as indicated in FIG. 4.

As further indicated in FIGS. 2-3B, the housings 54 of each of the level cut loop looper and clip assembly units 46 generally can include an upper section or top portion 61, and first and second or forward and rearward sections 62A/62B, with an open space, cavity or channel area 63 defined therebetween. The forward and rearward sections also can include slots or passages 64 formed therein and through which a series of clips 70 that are associated with each of the level cut loop loopers or hooks 45 will be received and which can help guide the clips as the clips are moved between extended and retracted positions with respect to their associated level cut loop loopers, as indicated by arrows 71 and 71' in FIG. 3B, as the level cut loop loopers are reciprocated toward and away from the needles of the tufting machine, as indicated at arrows 72 and 72' in FIGS. 1 and 3A. In addition, recesses or channels also can be formed within the open area or space 63 formed within each housing to help further guide the clips 70 as they are moved along the housings and along their associated level cut loop loopers 45 between their extended and retracted positions.

Each of the level cut loop loopers 45 generally will include a body 73 having a rearwardly extending shank portion 74 received within one of the gauge blocks or modules 47, and a forwardly extending throat portion 76 terminating in a hooked forward end or bill 77. In one embodiment, the level cut loop loopers further can include a channel or recessed 78 formed along the shank portions of their bodies and in which the clips 70 can be received and slide. As the level cut loop loopers are reciprocated forwardly in the direction of arrow 72, they can engage the needles, which have penetrated the backing material as indicated in FIG. 3A, so as to pick and pull loops L of yarns Y therefrom. When the clips are in their retracted positions, the loops of yarns can be collected and retained along the throat portions of the level cut loop loopers, whereas when the clips are in their extended positions, such as shown in FIG. 3A, the loops of yarns can be substantially blocked or retarded from being captured and retained along the throats of the loopers, generally being released from their level cut loop loopers as the level cut loop loopers are reciprocated rearwardly in the direction of arrow 72' so as to form loop pile tufts of yarns in the backing.

As further indicated in FIGS. 1 and 3A, a series of knives or cutting blades 81 generally can be mounted adjacent each of the level cut loop loopers 45. Each of the knives 81 generally will be mounted within a holder 82 coupled to a reciprocating arm or similar drive 83, which causes the knives to be reciprocated into engagement with the throat portions 76 of their associated level cut loop loopers for cutting any loops of yarns retained thereon to thus form cut pile tufts of yarn within the backing.

Each of the clips 70 generally will include a substantially elongated body 85 having a first, front or proximal end 86 and a second, rear or distal end 87. As shown in FIGS. 2-3B, the first or front ends 86 of each of the bodies 85 of each of the clips 70 generally will include a tapered projection or finger 88 defining a recessed or curved area or section 89 along the front of each clip, which recessed area and tapered projection are configured to generally close off or block the passage of a loop of yarn onto the throat portion of its associated level cut loop looper when the clip is in its extended position while still enabling the pick-up and/or formation of a loop of yarn by the level cut loop loopers as needed for forming loop pile tufts in the backing.

A pivot arm 91 connected to the body 85 of each clip 70 adjacent its second or rearward end 87, as further indicated in FIGS. 2-3B. The pivot arms can be pivotally attached to their clips by pins 92, and further generally will be pivotally or hingedly coupled to the housing of their level cut loop looper assembly units. In one embodiment, the pivot arms 91 can include a recess or arcuate channel 93 in which a tab, projection or similar linking member 94 can be received and about which the pivot arm can rotate. The tabs or other projections 94 can be mounted to or can be substantially integrally formed with the rear section or portion of the unit housings. Alternatively, the pivot arms can be pivotally coupled to their housings by pivot pins or other means, as will be understood by those skilled in the art.

The lower ends 96 of the pivot arms 91 will be connected to springs or other biasing members 97, which in turn can be connected to a spring retainer 98. Each spring retainer 98 can be integrally formed with its unit housing, along the base or lower section 57 thereof, or alternatively can be mounted to the housing, for example, being secured in place by the fasteners 56 securing the housing to the gauge bar 51. In one embodiment, as illustrated in FIGS. 2-3A, the spring retainer 98 can have a substantially T-shaped construction, although other shapes or configurations also can be used, with one or more hooked or protruding portions 99 along which the springs 97 can be engaged and connected to the housing. Alternatively, pins, tabs or other connectors can be provided along the spring retainer for engaging and securing a first end 101 of each spring 97 thereto, with the second or opposite end 102 of each spring connected to the lower end portion 96 of a pivot arm 91 as indicated in FIGS. 2 and 3A.

In one embodiment, the pivot arms 91 can be formed of varying, different lengths with different length pivot arms being connected to alternating ones of the clips 70 as indicated in FIGS. 2A and 3B. As a result, the spacings between the pivot arms and their clips can be reduced, to enable a more closely packed or more tightly spaced arrangement with potential interference between adjacent clips during operation being substantially minimized. Still further, the springs also can be mounted at different elevations and/or different size springs can be used to additionally help provide a reduced or more compact spacing between the clips 70 of the level cut loop looper and clip assembly, while avoiding potential interference of the operation of the clips 70 and/or the movement of their springs and pivot arms during a tufting operation.

A stop member 105 further will be positioned rearwardly of the level cut loop looper and clip assembly 10, as indicated in FIGS. 2-3B and 5. The stop member 105, in one embodiment, can include a generally L-shaped bar mounted to the tufting machine frame and having a forwardly projecting upper section 106 and a downwardly projecting rear section 107. During a tufting operation, as the level cut loop loopers are reciprocated rearwardly, in the direction of arrow 72', away from their needles, the second ends 87 of the clips 70 will engage the rearward section 107 of the stop member 105, which acts as a mechanical stop that resists further rearward movement of the clips. As a result, as the level cut loop loopers continue to reciprocate rearwardly, the clips 70 are caused to be moved forwardly along their associated level cut loop loopers, in the direction of arrow 71 (FIG. 3B), into their extended positions covering or substantially blocking the throat portions of their level cut loop loopers. Thereafter, as the level cut loop loopers are reciprocated forwardly in the direction of arrow 72, toward the needles, the springs attached to the pivot arms of each clip will cause the clips to be retracted from their extended positions in the direction of arrow 71', opening the throats of the level cut loop loopers to enable capture of loops of yarns therealong. Thus, during each reciprocation or stroke of the level cut loop loopers of the level cut loop looper and clip assembly 10, the clips are substantially automatically moved into and out of their extended positions as a result the mechanical operation of the looper drive of the tufting machine driving the reciprocation of the level cut loop loopers, without the need to substantially independently or separately drive the clips into such positions.

As indicated in FIG. 2, a series of actuators 110 are mounted along the upper surface 61 of the housings 54 of each of the level cut loop looper and clip assembly units 46. In one embodiment, the actuators can comprise direct acting solenoids each coupled to a detent or locking bar 111 (FIG. 3B), which can be extended through the housing upon actuation of its actuator 110 to engage a recessed area or locking gap 112 formed along the body of a clip 70 aligned or associated therewith. As the clips 70 are driven forwardly during a rearward reciprocation of their level cut loop loopers upon engagement of their rear ends with the stop member 105, the actuators can be selectively engaged so as to cause their detents 111 to be moved into engagement with the locking recesses or gaps 112 of their respective or corresponding clips so as to lock or substantially fix or secure the clips in their extended positions along the throats of the level cut loop loopers. As a result, a more rapid location of the clips of the level cut loop loopers into their extended or blocking positions can be achieved as needed for selectively forming cut and loop pile tufts in the backing, as the actuators are not required to drive the clips from a fully retracted to an extended, engaged position, since the clips are already substantially automatically moved to their engaging positions by the reciprocation/operation of the level cut loop loopers, and thus the actuators can simply act to lock the clips in place. As a further result, the clip extend tolerance or required movement of the clips can be substantially reduced, as indicated by arrow A in FIG. 3B, and the rate at which the tufting machine is operated can be increased. It will also be understood that while a solenoid is shown in one embodiment for use with the level cut loop looper and clip assemblies for fixing the clips in their extended positions, other types of actuators, such as pneumatic, hydraulic or other fluid cylinders or piezo-electric actuators also can be used.

In addition, the springs or biasing members 97 for urging the clips to their retracted or non-engaging positions can be replaced with other mechanisms. For example, a magnetic detent could be used, wherein the clips can be magnetically held in a retracted position against the stop member and selectively released from such engagement as needed when the actuators 110 of selected clips are actuated to secure the selected clips in their extended positions.

As additionally illustrated in FIGS. 2 and 5, the housings of the units of the level cut loop looper and clip assembly 10 further can be provided with a generally offset or staggered configuration including a series of stepped sections or portions 115 along one side edge thereof and corresponding recessed portions 116 along the opposite side thereof. Such a stepped or recessed configuration enables the units to be mated together and mounted along the gauge bar in a substantially nested or engaged configuration, which helps provide a more compact assembly footprint. In addition, the actuators 110 further can be mounted in a staggered, offset arrangement, as indicated in FIG. 5, wherein, in one embodiment, a series of twelve actuators are shown mounted in four angled or offset rows of 3 actuators. The staggered/nested arrangement enables the actuators to be more tightly spaced together to provide for a substantially compact assembly that is also capable of being used as a replacement or retrofit with existing tufting machines, without requiring a substantial reconfiguration or reconstruction thereof in order to fit the level cut loop looper and clip assembly 10 therein without interference with the frame or other operative components of the tufting machine.

With the level cut loop looper and clip assembly of the present invention, the actuation and/or movement of the clips can be controlled and operated with increased precision and at faster rates as the movement of the clips is accomplished or provided with each stroke or reciprocation, rather than having to individually engage and move each clip by actuation of a cylinder or other drive mechanism. Additionally, the stroke or length of travel of the clips can be substantially reduced, which also can help improve operational rates, while the complexity and cost of operation of the level cut loop looper and clip assembly of the present invention can be reduced. Thus, the present invention can enable production rates and increased consistency of operation for selectively forming loop pile and cut pile tufts while reducing the overall cost of the level cut loop looper and clip assembly and operation thereof.

It will be understood by those skilled in the art that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed:

1. A tufting machine, comprising:

a series of needles moved in a reciprocating motion and carrying a plurality of yarns into and out of a backing material; and a series of level cut loop looper and clip assembly units, each comprising:

a plurality of level cut loop loopers, reciprocated toward and away from the needles as the needles are reciprocated into and out of the backing material, so as to engage and pick-up loops of yarns from said needles for forming tufts in the backing material;

a plurality of clips each movable along an associated one of said level cut loop loopers between a retracted portion and an extended position; and a plurality of actuators, each actuator having a locking member moveable into engagement with one of said clips, wherein as said level cut loop loopers are reciprocated toward and away from said needles, at least some of said clips are moved along their associated ones of said level cut loop loopers toward their extended positions, and wherein one or more selected ones of said actuators are engaged and move their locking members into contact with selected ones of said clips to substantially locate said selected clips in their extended positions along said level cut loop loopers associated with each of said selected clips for substantially blocking capture of loops of yarns picked up by said level cut loop loopers associated with said selected clips.

2. The tufting machine of claim 1, wherein said actuators comprise at least one of a solenoid, piezo-electric actuator, a pneumatic cylinder, or a fluid cylinder.

3. The tufting machine of claim 1 and wherein said clips comprise tapering projections configured to facilitate pick-up and release of the loops of yarns picked-up from the needles by said level cut loop loopers to form loop pile tufts.

4. The tufting machine of claim 1, wherein said level cut loop loopers each comprise a shank, a throat extending forwardly from said shank, and a forward end configured to pick-up and capture a loop of yard along said throat.

5. The tufting machine of claim 4, further comprising a series of knives, each moveable into engagement with one of said level cut loop loopers to cut loops of yarns captured along said throats of said level cut loop loopers to form cut pile tufts.

6. The tufting machine of claim 1, further comprising a pivot member mounted to each of said clips and to a biasing element, wherein each of said clips is biased toward its retraced position, and a stop member positioned to be engaged by said clips as said level cut loop loopers are reciprocated away from said needles to cause movement of said clips toward their extended positions along said level cut loop loopers.

7. The tufting machine of claim 1, wherein each of said clips comprises a recess located along its body and configured to receive one of said locking members of one of said actuators aligned therewith so as to substantially lock said clip in its extended position.

8. The tufting machine of claim 1, wherein said plurality of level cut loop loopers are mounted in spaced series within a module of one of said level cut loop lopper and clip assembly units.

9. A tufting machine, comprising:

at least one reciprocating needle bar with a series of spaced needles mounted therealong;

a yarn feed mechanism feeding yarns to each of the needles;

backing rolls feeding a backing material through the tufting machine;

a level cut loop looper and clip assembly mounted below the backing material, the level cut loop looper and clip assembly comprising:

a series of level cut loop loopers reciprocable toward and away from the needles as the needles pass into and out of the backing material for forming a series of tufts of yarn in a backing material, a series of clips, each movable along an associated one of the level cut loop loopers, and a series of actuators arranged adjacent the level cut loop loopers and clips, each actuator being selectively operable to engage and substantially lock a selected clip of a selected level cut loop looper in an extended or a retracted position along the selected level cut loop looper for forming a cut or a loop pile tuft of yarn in the backing material.

10. The tufting machine of claim 9, wherein said actuators comprise at least one of a solenoid, piezo-electric actuator, a pneumatic cylinder, or a fluid cylinder.

11. The tufting machine of claim 9, wherein each of said clips comprises a recess configured to receive the locking member of an associated one of said actuators therein to substantially lock each of said clips in an extended position.

12. The tufting machine of claim 9, further comprising a stop member positioned adjacent a distal end of each of the clips located in a position so as to be engaged by and cause movement of the clips along their level cut loop loopers and toward their extended positions, as said level cut loopers are reciprocated away from the needles.

13. The tufting machine of claim 9, further comprising a pivot member mounted adjacent the distal end of each of the clips, and a biasing element mounted to an opposite end of each pivot member, whereby each of the clips is biased toward a retracted position as the level cut loop loopers and clips are reciprocated toward the needles.

14. The tufting machine of claim 9, wherein the level cut loop looper and clip assembly further comprises a series of units each having a unit body along which the level cut loop loopers are mounted, with the clips thereof extending through the unit body, and wherein each of the clips is movable through the unit body between retracted and extended positions as the units are reciprocated toward and away from the needles.

* * * * *